United States Patent [19]

Petersen

[11] Patent Number: 4,721,294

[45] Date of Patent: Jan. 26, 1988

[54] DEVICE FOR FOLDING AND CONTINUOUS HANDLING OF PRINTED MATERIALS

[75] Inventor: Godber Petersen, Augsburg, Fed. Rep. of Germany

[73] Assignee: MAN - Roland Druckmaschinen Aktiengesellschaft, Offenbach am Main, Fed. Rep. of Germany

[21] Appl. No.: 756,780

[22] Filed: Jul. 18, 1985

[30] Foreign Application Priority Data

Jul. 26, 1984 [DE] Fed. Rep. of Germany ..... 3427570

[51] Int. Cl.[4] ..... B41L 43/12

[52] U.S. Cl. ..... 270/37

[58] Field of Search ..... 270/53, 37, 54, 21.1, 270/58; 493/356–361, 405, 416–417, 422–426

[56] References Cited

U.S. PATENT DOCUMENTS

| | | | |
|---|---|---|---|
| 3,966,185 | 6/1976 | McCain et al. | 270/37 |
| 4,179,107 | 12/1979 | Harris | 270/37 |
| 4,420,147 | 12/1983 | Knox | 270/37 |
| 4,479,642 | 10/1984 | Macey | 270/53 |
| 4,499,834 | 2/1985 | Ruetschle | 270/53 |
| 4,552,497 | 11/1985 | Kockler et al. | 270/37 |
| 4,576,369 | 3/1986 | Flensburg et al. | 270/54 |

*Primary Examiner*—E. H. Eickholt

*Attorney, Agent, or Firm*—Frishauf, Holtz, Goodman & Woodward

[57] ABSTRACT

The webs of printed material 1*a*, 1*b* printed in a printing machine are assembled in the desired manner, after being previously cut, via various deflectors (e.g., 12, 17, 18, 23, 24, etc.) and are optionally provided with inserts or wrappers which have been cut to size and come from rolls (40, 41). After braking has been effected in braking stages (e.g., 37*a*–37*h*), the fold is formed on folding tables (38*a*–38*h*). The folded products can be assembled in any desired manner on collecting tables, after which they are either paid out below the collecting tables (39*a*–39*h*) or combined with further folded products (FIG. 1).

7 Claims, 7 Drawing Figures

DEVICE FOR FOLDING AND CONTINUOUS HANDLING OF PRINTED MATERIALS

The invention relates to a device for folding and further handling of printed materials, which are delivered via cutting devices to one or more folding units by means of conveyor belt systems, after which the folded products are assembled and/or paid out.

BACKGROUND

From the reference book, "Atlas des Zeitungs- und Illustrationsdruckes" [*Atlas of Newspaper and Illustration Printing*] by Alexander Braun, published by Polygraph Verlag, it is already known to fold webs of printed material, which have been cut to size beforehand, by means of rotating elements such as folding blade cylinders, folding gripper cylinders and collection cylinders and assemble them and handle them further, for instance paying them out via bucket wheels (see especially pages 78 ff.). From page 85 of the same book, it is also already known to push sheets, or packets of sheets, through a pair of rollers in order to produce a fold. All these known devices have the disadvantage that the folding systems must be driven at the same speed as the machine. As the printing output increases, that is, as the machine speed becomes faster, problems arise in terms of a proportional speed increase on the part of the folding systems.

THE INVENTION

It is the object of the invention to provide an apparatus for folding and further handling of printed materials, in which despite the increasing speed of printing machines, folding can proceed at a relatively low speed, and in which individual assembly of the webs of printed material that are to be handled, such as inserting brochures and the like, can be done, and further handling of the folded products that is adapted to particular requirements is possible and simple.

Deflectors are provided located downstream—in the path of moving sheets—of cutting devices which cut a moving web into individual sheets. Sheet speed braking stages are located downstream of the deflectors to brake the speed of the moving sheets for subsequent folding. The braking stages, preferably, include a belt transport system operating at a first, higher speed and a removal belt transport system operating at a second, slower speed, with a third braking belt system intermittently operating at higher and lower speeds, in timed relation to the arriving sheets, to match arrival and delivery speed. The slowed sheets are then transported to a plurality of folding tables, on which they are aligned, retained, and folded by a folding knife or blade, for subsequent transport to collecting tables, for assembly with similarly folded sheets. The assembled, folded sheets are then pushed by a blade from above the collecting table into movable receiving containers, disposed below the collecting tables, for subsequent handling.

The drawings show:

FIG. 1, an overall view of the device according to the invention for folding and further handling;

FIG. 2, more-detailed views of the folding and collection tables of FIG. 1;

FIG. 3, an arrangement for folding and assembling products in order to produce periodicals or books;

FIG. 4, an advantageous delaying stage used in FIG. 1; and

FIGS. 5–7, advantageous embodiments of deflectors that are used in the device according to FIG. 1.

DETAILED DESCRIPTION

As already noted, the folding devices already known for rotary printing machines operate at full machine speed. In order to be able to pay out the folded products, they must therefore be braked. The operations that must be performed often in the folded device, such as collecting and stitching or stapling, also had to be done at full machine speed, that is, at the speed of the web emerging from the printing machine. As the operating speed of modern printing machines rose, it was accordingly necessary to increase the speeds of the folding devices in proportion; this was increasingly difficult to control. A further factor is that the imbricated flows of material formed in the folding devices, or at their outlets, were not ideal for further handling of periodicals or books. Only limited numbers of pages could be handled, for example, which was predominantly due to physical factors in the folding operation. Previously, the paid-out folded products were therefore initially bundled and stored, and then later handled along with other folded products produced in the same manner, for instance with accompanying material being inserted or wrappers being provided, to produce finished products. It will be appreciated that this handling procedure was very expensive and time-consuming. The folded products had to be unfolded and assembled, stapled or stitched, and cut. The systems that accomplished this operated at much lower speed than the printing machine and the folding apparatus following it, so that a large number of identical devices had to be used in order to prevent bottlenecks. The device described herein offers the advantage of "in-line production", that is, production virtually from the printed roll of paper to the finished product, i.e. a complete periodical or book.

Figure 1:
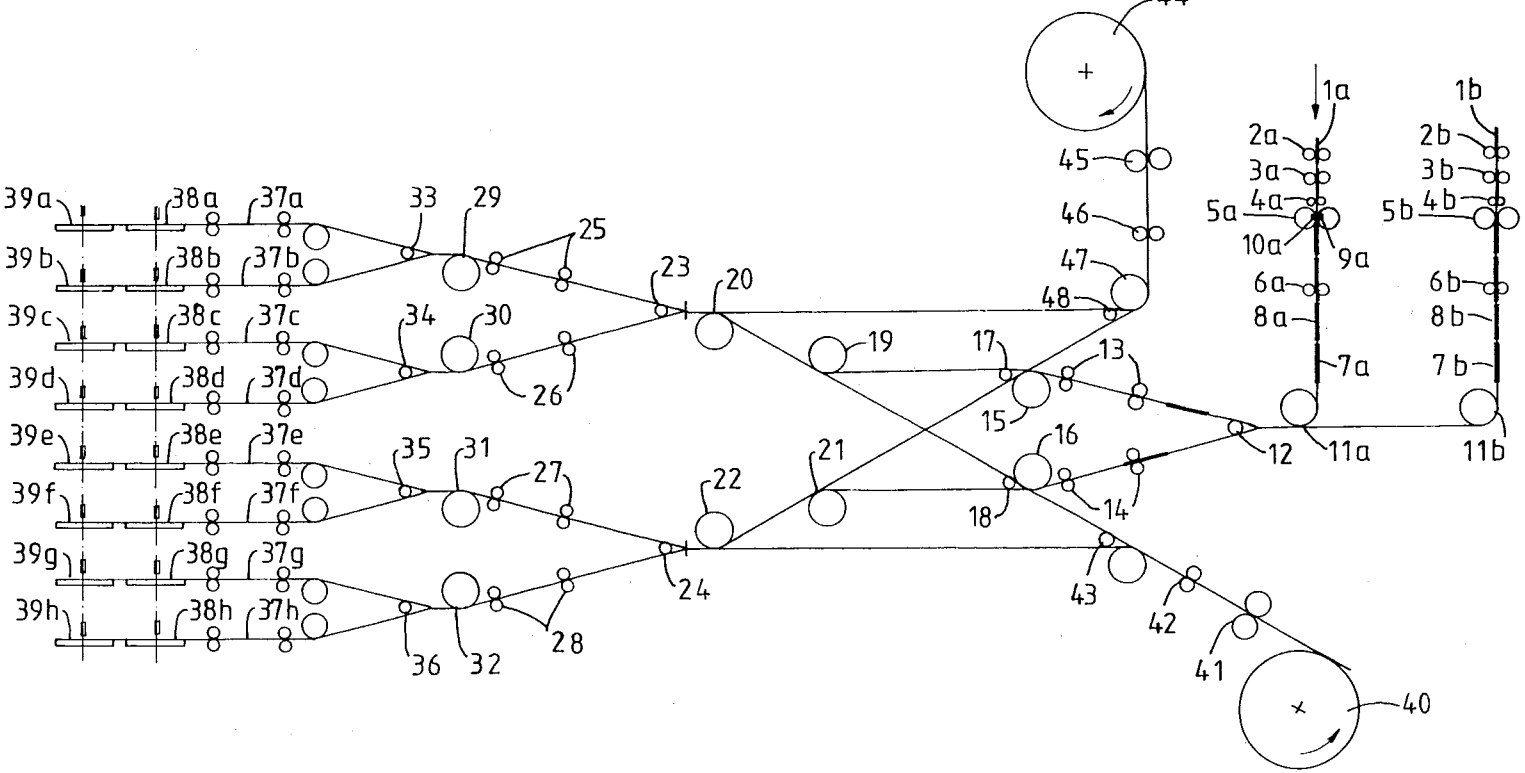

According to FIG. 1, webs of printed material 1*a*, 1*b* are delivered via pairs of tension rollers 2*b*–4*b*, each to a respective pair of cutting cylinders 5*a*, 5*b*, in which the webs of printed material 1*a*, 1*b* are cut crosswise, after which they travel through pairs of so-called web-braking rollers 6*a*, 6*b*. Preferably the folded products that have been cut to size, hereinafter called sheets 7*a*, 8*a* or 7*b*, 8*b*, undergo a certain advancement, so that they are spaced apart at intervals. To this end, the following system, including pairs of cutting cylinders 5*a*, 5*b*, is provided with an individually controllable single drive mechanism, so that it always runs slightly faster, as compared with the webs of printed material 1*a*, 1*b*. The speed of the webs of printed material 1*a*, 1*b* is determined by the circumferential speed of the preceding forme cylinders, not shown here, in the printing systems. Since the pair of cutting cylinders 5 cuts off the sheets in a clocked sequence, the advancement must be kept as small as possible. When a pair of variable-circumference cutting cylinders is used, the cutting beams 9*a*, 9*b* and the associated grooved beams 10, 10*b* can each be varied radially toward the center point of the cylinders. It will be understood that in this case the circumference and the center-to-center spacing of the cylinders must be varied simultaneously with respect to each other.

The sheets 8*a*, 7*a*, 8*b*, 7*b* are diverted by rollers 11*a*, 11*b* and then delivered to a first sheet deflector 12, which divides the sheets such that sheets 7*a* always move upwardly, for instance, and sheets 8 move downwardly. Since the spacing between the sheets now grows to twice the previous amount, the first braking can take place in the braking stages 13 and 14. An exemplary embodiment of a braking stage of this kind will be described in greater detail later herein. The course of the sheets now continues separately, with 7a upward and 8a downward, via rollers 15 and 16, deflectors 17 and 18, and finally rollers 19 and 20 or 21 and 22, respectively, and again to deflectors 23 and 24, where another division takes place, combined with another increase in spacing and an ensuing braking in stages 25–28. The same process is repeated once again after a passage past rollers 29–32 in deflectors 33–36 and braking stages 37a–37h, until finally the sheets reach folding tables 38a–38h, which are followed by collecting tables 39a–39h.

Wrappers or inserts can be delivered via the deflector 43 from a roll 40, the webs from which are severed by a pair of cutting cylinders 41 and are accelerated in the form of sheets in the web-breaking rollers 42; the delivery of accompanying material takes place by the same process from a roll 44 via a pair of cutting cylinders 45, web-breaking rollers 46 and a deflector 27.

A collecting and folding operation will now be described, in which the sheets 7a–8b are collected and provided with a wrapper and accompanying materials. At the roller 11a, sheets 7a and 7b, for example, are placed together and divided from the sheets 8a and 8b by the deflectors 12 in such a way that the sheets 7a, 7b move to the top and sheets 8a, 8b move to the bottom. The deflector 17 is switched such that four packets 7a, 7b of sheets in succession reach the folding tables 38a–38d, while four packets 8a, 8b are likewise placed on the folding tables 38e–38h via the deflector 18. At the same time, wrappers can be provided for the packet comprising the sheets 7a, 7b from the roll 40 via deflectors 43 and 18 at the roller 19, and accompanying materials can be delivered from the roll 44 via deflectors 38 for the roller 20. The entire packet, comprising the wrapper, the sheets 7a, 7b and the accompanying material, is now folded on the folding tables 38a–38d and immediately thereafter delivered, in the re-opened state, to the collecting tables 39a–39d. The packets 8a, 8b, meanwhile, have also been folded on the folding tables 38e–38h and arrive at the collecting tables 39e–39h. Immediately after the transfer of the sheets 8a, 8b, the collecting tables 39e–39h stitch or staple the entire packet as needed and send it on one after another. The deflectors 17 and 18 are then switched such that the sheets 7a, 7b are moved downward to the roller 22 and the sheets 8a, 8b are moved upward to the roller 20. The deflector 43 then guides the wrappers to the roller 22 as well, and the deflector 48 guides the accompanying materials to the roller 22. The entire packet, comprising the wrapper, the sheets 7a, 7b and the accompanying materials, now arrives at the folding tables 38e–38h and from there, after folding, arrives at the collecting tables 39e–39h, which in the meantime have been emptied again. Similarly, the sheets 8a, 8b have arrived at the folding tables 38a–38d, from whence, after folding, they are conveyed to the collecting tables 39a–39d, on which the folded packet comprising the wrapper, the sheets 7a, 7b and the accompanying materials are located in the unfolded state. Stapling or stitching is now done, and the packets are then paid out.

Figure 2:
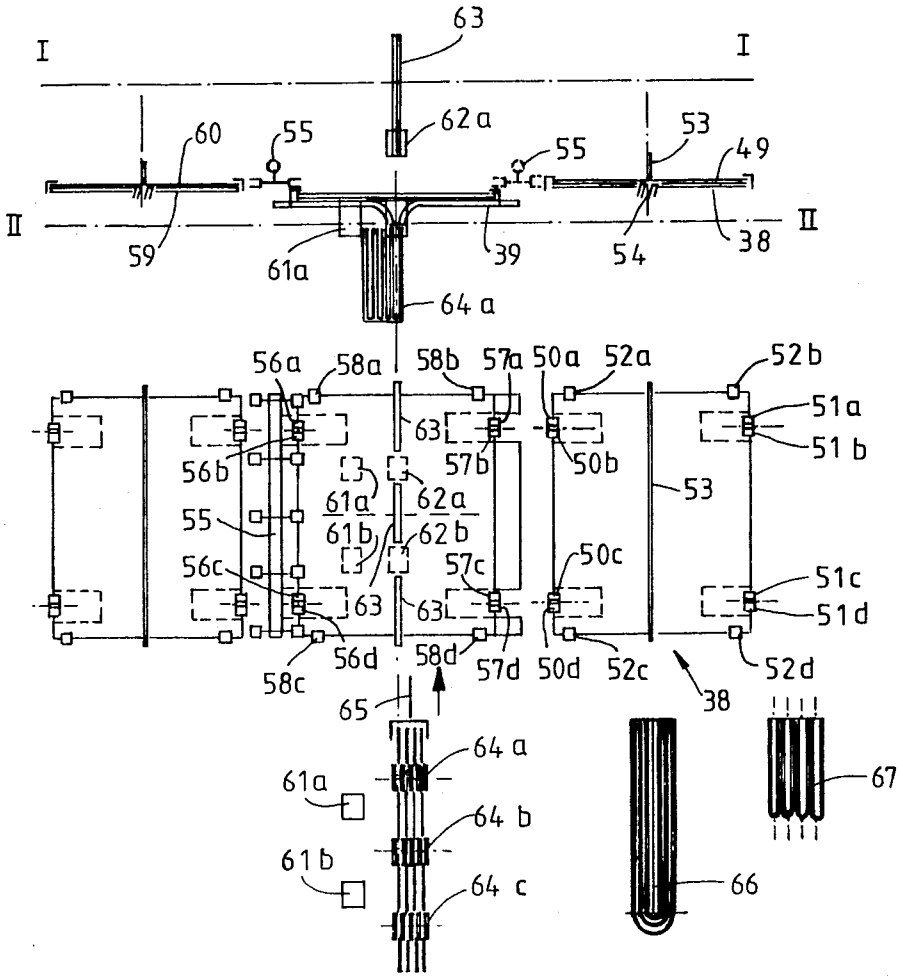

FIG. 2 is an enlarged view, showing a side and a plan view of the folding and collecting tables, the plan view being taken along the line I—I. As described in conjunction with FIG. 1, a packet of sheets 49 reaches the folding table 38, where it is immediately aligned by means of adjustable and controlled stops 50. The gripper-like stops 50a and 50d, for instance, accept the product in a controlled up-and-down movement, while the stops 50b and 50c firmly hold the item located on the folding table. Before the stops 50a and 50d press the sheet firmly onto the folding table 38, stops 51a–51d, likewise in the form of grippers, in a likewise alternating movement parallel to the center of the fold, assume the function of lateral guidance. Since the item comprises individual sheets, which may need to be aligned with respect to one another, the item is made to curve slightly upward, away from the folding table 38, by moving the stops 50, 51 toward one another. During the folding operation, a folding blade 53 then assumes a portion of the alignment work. The folding table can reinforce this operation by vibrating. On the folding table 38, no more sheets can be collected than a satisfactory folding operation allows. During folding, the gripper-like stops 50a–50d firmly hold the sheets, while in a controlled downward movement the folding blade 53 pushes the item 49 into the folding gripper 54, which forms a folded crease by means of a short, fast closing movement. The item thus remains opened during the folding movement. After the folding gripper and folding blade have released it, it is accepted by the gripper arm 55 in the position shown in broken lines and pulled onto the collecting table 39, where gripper-like stops 56a–56d, 57a–57d and 58a–58d accept it and align it in the same manner as has been described for the folding table 38. In the device shown in FIG. 2, the gripper arm 55, upon moving backward into the position shown in broken lines, can likewise pull a pre-folded item 60 from the folding table 38 across the collecting table 39. The collecting table 39 thus accepts as many pre-folded items 49, 60 and are needed to produce the finished item. After this operation is complete, the collected item can be stapled or stitched by stapling or stitching heads 61a and 61b and staple or stitch closers 62a and 62b. To this end, the heads 61a and 61b move into the center of the fold and then pivot away again once stapling or stitching is finished. Immediately after this, a folding blade 63 pushes the item into receiving tongues 64a–64c. If the receiving tongues 64a–64c have four chamber, for example, as shown in FIG. 2, then up to four completed items can be accepted by moving the tongues 64 forward in increments in the direction of the arrow. They are then removed laterally in common by the gripper 65, as shown in FIG. 2 in the section taken along the line II—II, and delivered to further conveyor systems of known design, not shown here.

Each of the four chambers of the receiving tongues 64a–64c shown in FIG. 2 can contain a folded product 66 equipped with the proper number of pages. If stapling or stitching is dispensed with, then with an appropriate size and shape the sum of all four chambers results in an assembled item 67 that has grown to the thickness of a book. It is likewise accepted by the gripper 65 and, as will be shown later, delivered to further handling stations until the book is complete. For the purpose of book production, the pair of cutting cylinders 5a of FIG. 1 can be provided on the circumference of each cylinder with two cutting bars 9a and grooved bars 10a, in order to produce shorter cutting lengths for the smaller size typical for books. To this end, all the stops 50a–50d, 51a–51d, 52a–52d, 56a–56d, 57a–57d, and 58a–58d adjustable on the folding and collecting tables are likewise adjustable to the appropriate format size.

Figure 3:
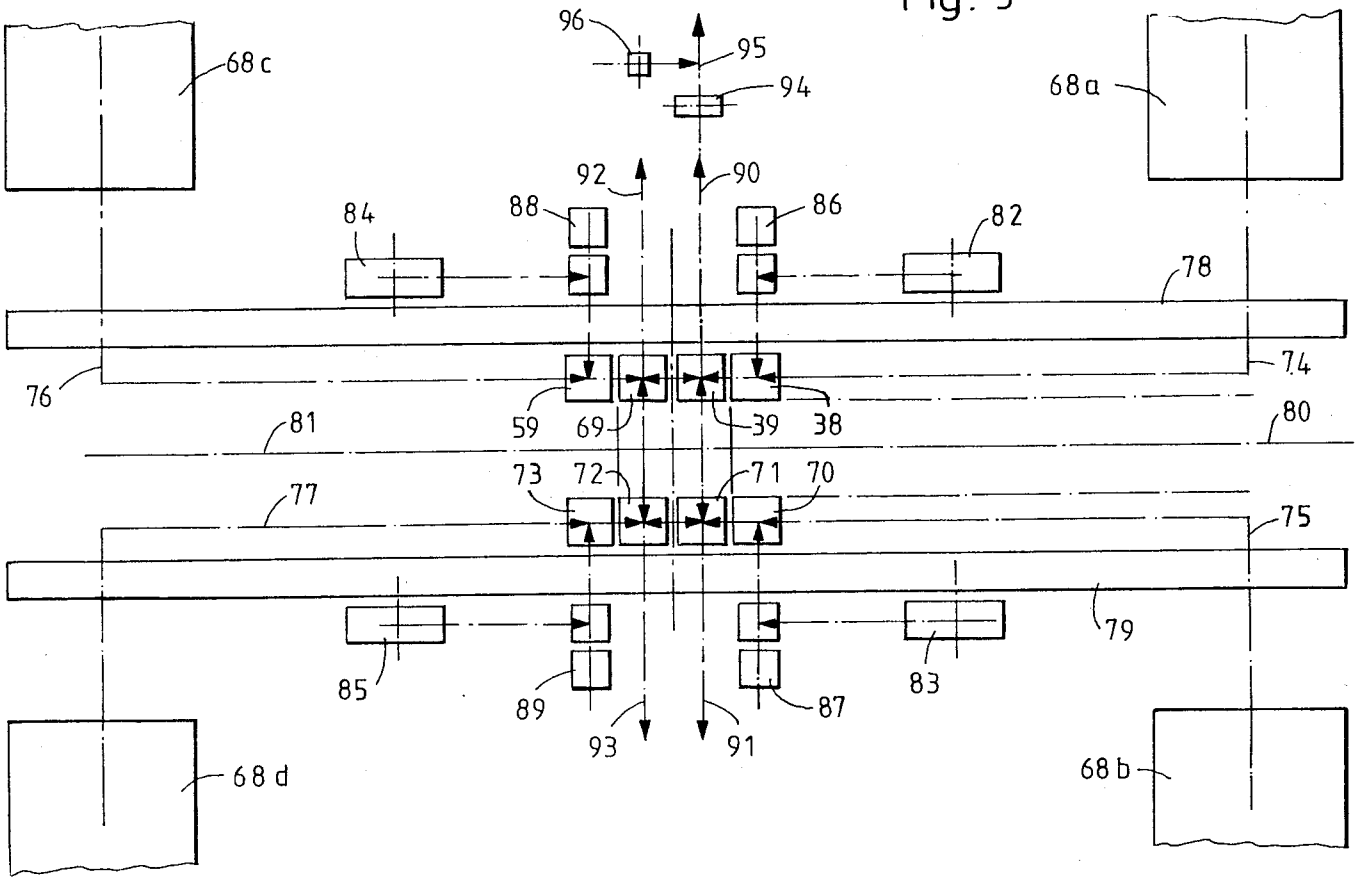

FIG. 3 is a plan view of a complete book and periodical production system. From four rows of printing systems 68*a*–68*d*, for instance, come four printed webs 74–77, which are each handled in the same manner as that described in conjunction with FIG. 1. A total of four complete units according to FIG. 1 are each suspended from, one side on both walls 78 and 79 of the machine, in the respective regions from the web 74 to the collecting table 39, from the web 75 to the collecting table 71, from the web 76 to the collecting table 69 and from the web 77 to the collecting table 72 and are thus accessible at any time from catwalks 80 and 81. As FIG. 3 also shows, wrappers or accompanying material can be fed into the routes indicated by directional arrows onto the folding tables 38, 59, 70, 73 from web storage rolls 82–85. Alternatively, already-folded items can be fed in from the stacks 86–89. Naturally, storage rolls can also be used, instead of the printing systems 68*a*–68*d*, examples being webs of printable material which have been printed beforehand and stored on these rolls. Each storage roll 82–85, as already indicated in FIG. 1 for the rolls 40 and 44, is assigned its own pair of cutting cylinders and an associated pair of web-breaking rollers, which brings the cut sheets to the appropriate feed-in speed. With a system according to FIG. 3, both periodicals and books can be produced. The folded and if need be stapled or stitched items either leave the collecting tables 39, 69, 71 and 72 directly, in the respective directions of the arrows 90, 91, 92 and 93, or else they are passed from one collecting table to the next, as indicated by the directions of the arrows in FIG. 3. For instance, the pre-folded items can move, in the still-open condition, from the collecting table 71 to 39 and from 72 to 69, and then those items collected on table 69 can move to the table 39, where they enter the receiving tongues 64*a*–64*c* in the manner shown in FIG. 2. This conveyance of sheets is also possible in the closed state, however, directly in the plane of the receiving tongues 64 (FIG. 2), even for relatively large numbers of pages. Each of the collecting tables 39, 69, 71 and 72 naturally has receiving tongues below the plane of the table, from whence the closed items can move, via a gripper similar to the gripper 65 in FIG. 2, from 71 to 39 and from 72 to 69. The packets of items below the tables 39 and 69 are then moved by grippers 65 (FIG. 2) in the direction of conveyance indicated by the arrows 90 and 92, and the items are moved from 92 to 90, where they can be assembled. Thus it is entirely possible, in principle, to transport the sheets in the open state inside the plane of the collecting table, or to transport them in the closed state inside the plane of the receiving tongues.

As FIG. 3 also shows, the packets of items move in the direction of the arrow 90 via a milling station 94 to a gluing station 95, where they can be provided with wrappers 96 to become finished books.

As will be apparent from the foregoing description, the capacity of a system according to FIG. 1 or FIG. 3 does not depend only on the number of folding and collecting tables. It can be expanded as desired. If there are eight folding and collecting tables as in FIG. 1, then the sheet speed directly prior to the folding tables can be reduced to ⅛ of the web speed of the entering web. The folding, collecting and stitching or stapling movements therefore take place at substantially lower speeds.

Figure 4:
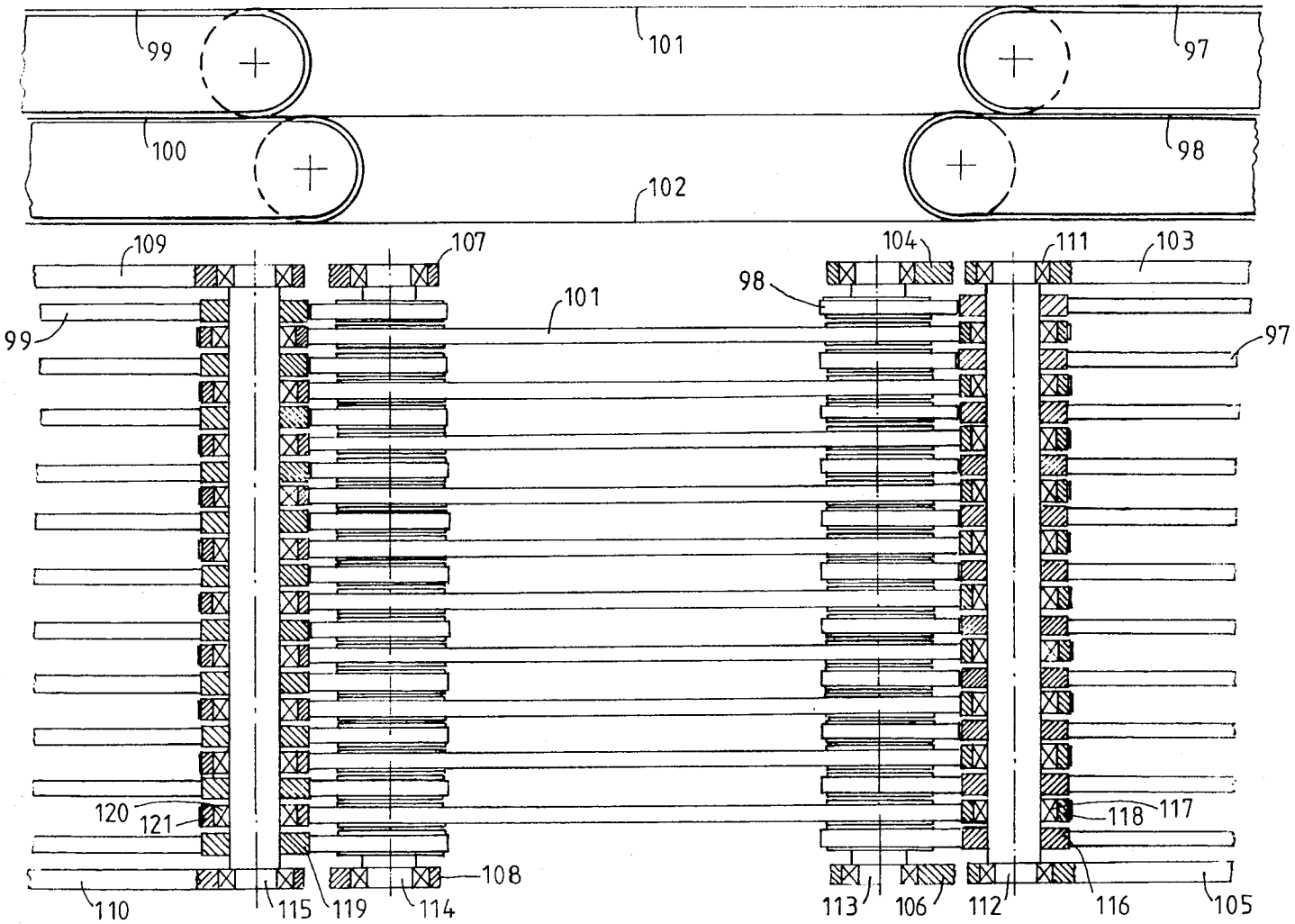
Figure 7:
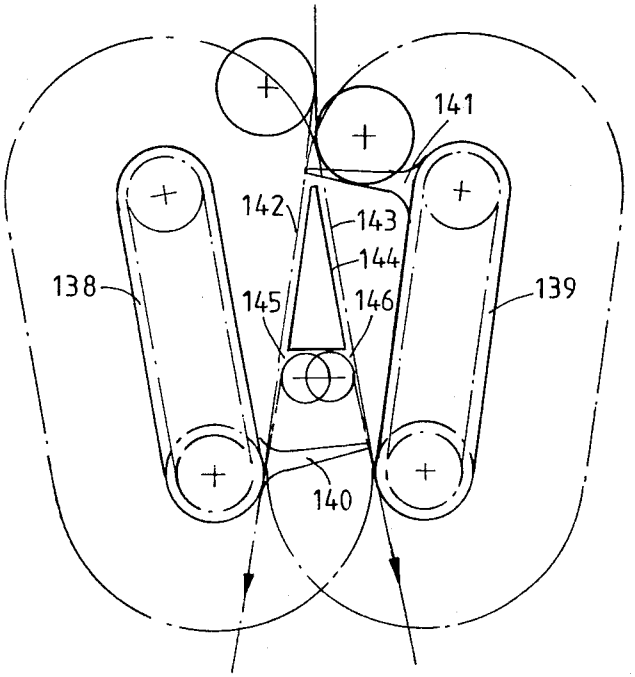
Figure 6:
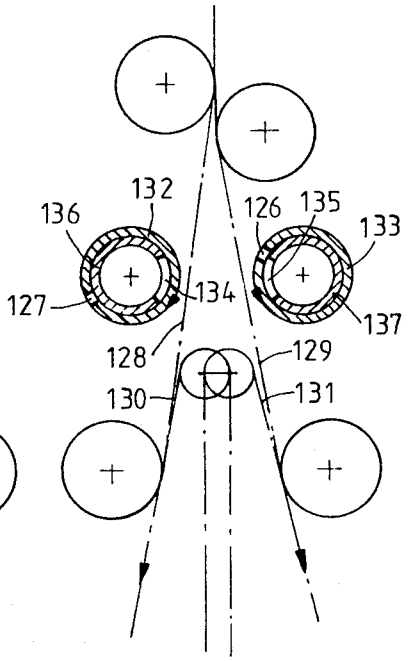
Figure 5:
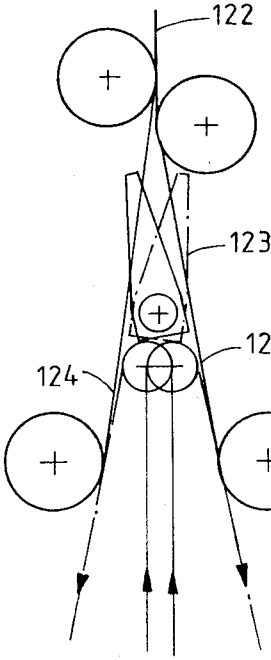

FIG. 4 shows side and top views of the numerous braking stations inside the conveyor belt system, for instance the station 13 of FIG. 1. The conveyor system having the speed $V_1$ comprises ten belts 97 in the upper part and ten belts 98 in the lower part; likewise, the conveyor system having the speed $V_2$ comprises ten belts 99 in the upper part and ten belts 100 in the lower part. Between these two conveyor systems, there is a belt system having a variable speed, for example comprising ten belts 101 in the upper part and ten belts 102 in the lower part. The belt systems are supported in the support arms 103–110, which receive the roller bearings 111 of the spindles 112–115. Each of the two spindle 112 and 113 carries, in alternation, a roller 116 firmly joined to it and a roller 118 supported on a bearing 117. Each of the spindles 114 and 115 carries also, in alternation, a roller 119, firmly joined to it and a roller 121 journalled on free-wheeling couplings 120. The intermediate belt system, comprising the belts 101 and 102, can now assume any speed in the range between $V_1$ and $V_2$. If it has dropped to $V_2$, then the system is driven via free-wheeling shafts 120 by coupling 115 and 114, which are driven in turn via the roller 119 by the belts 99 and 100 at $V_2$. On the other hand, the roller bearings 117 do not allow any driving at the speed $V_1$ of the belts 97 and 98. If a sheet is transported into the belts 97 and 98 at the speed $V_1$ and reaches the vicinity of the disks 116 and 118, then the belts 101 and 102 are accelerated by the frictional engagement of the paper at the circumference of the roller 118. The sheet is transported further at the speed $V_1$ only until its end has passed the rollers 116 and 118. Then, because of friction and air resistance, the speed gradually decreases. Once it has dropped to $V_2$, the belts 101 and 102 are driven via the free-wheeling couplings 120. This occurs no later than when the rollers 119 and 121 are reached, where the frictional engagement at the circumference of the rollers 121 is equivalent to the speed at those of the fixedly driven belts 99 and 100. Because of the continual acceleration and braking of the intermediate belt system, this system should have the least possible moment of inertia and should have an easy-action bearing. The rollers 118 and 121 should therefore be advantageously fabricated of plastic, for example. By braking the sheets in this manner, it is assured that the sheet is clamped everywhere between the belts, not as in the prior art being floatingly transported between belt systems of different speeds. Referring to FIGS. 5–7, some advantageous, partially novel forms of sheet deflectors will now be briefly described. In FIG. 5, the sheet arriving from the belt system 122, for instance in a known manner by the controlled deflection of the tongue 123 into one or the other position, is steered into the belt system 124 or 125. In FIG. 6, this deflection is accomplished in a novel manner by means of air nozzles 126 and 127, which by means of their jet of air press the sheet in alternation against the opposite belt system; that is, the nozzles 126 press it against the belt system 128, or the nozzles 127 press it against the belt system 129, so that for being further transported it enters the following belt opening 130 or 131. The nozzles 126 and 127, in the form of tubes provided with openings, are mounted for instance on stationary rollers 132 or 133. The former elements rotate in increments timed with the sheet in the direction of the arrow, and with their openings they pass over the slits 134 and 135 in the air supply tubes 136 and 137 and thereby uncover the air outlet in a controlled manner.

In FIG. 7, the beginning of the sheet is, again in a a novel manner, introduced in alternation, by means of cams 140 and 141 firmly joined to toothed belts 138 and 139, into the gap between the belts 142 or 143 on the one hand and the fixed guide tongue 144 on the other and is transported together with the belts 142 and 143 into the belt opening 145 or 146.

I claim:

1. Device for folding and further handling of moving printed material, in which cutting devices provide cut items and deliver printed and cut material by means of belt conveyor systems to one or more folding units to form folded products, after which the folded products are processed by at least one of: assembly, pay-out delivery, characterized by a plurality of folding tables (38*a*–38*h*);

rentention and alignment devices (50*a*–50*d*) associated with the respective folding tables;

folding blades (43) located above respective folding tables;

deflectors (12, 17, 18, 43, 48, 23, 24, 33, 34, 35, 36), disposed following the cutting devices (5*a*, 5*b*, 41, 46), braking stages (13, 14, 25–28; 37*a*–37*h*) located between and downstream of the deflectors, for delaying and guiding the cut items to be folded (7*a*, 7*b*, 8*a*, 8*b*) and transporting the cut items onto one of the plurality of folding tables (38*a*–38*h*), on which they are aligned and retained by the retention and alignment devices (50*a*–50*d*) and can be pushed by means of a respective folding blade (43) into a briefly closable folding gripper (38*a*) in order to produce a fold and form folded items, further transport devices (55) transporting the folded items (49) onto a collecting table (39) for assembly with a plurality of previously folded items (60) from other folding tables (49) with identical folds to form the folded products; and a pushing blade (63) disposed above the collecting table (39) for pushing the folded assembled items (49, 60) forming said folded products into movable receiving containers (64*a*–64*c*) disposed below the collecting table (39).

2. Device according to claim 1, characterized in that the movable receiving containers (64*a*–64*c*) are movable below the collecting tables (39) in order to receive further collected folded items (49, 60).

3. Device according to claim 1, characterized in that stapling or stitching heads (61*a*, 61*b*) are disposed below the collecting tables (39) and stapling or stitching closers (62*a*, 62*b*) are disposed above the collecting tables, and that the stapling or stitching heads (61*a*, 61*b*) are movable briefly into a folding line.

4. Device according to claim 1, characterized in that a plurality of collecting tables (39) are disposed one after the other and one beside the other, to which via a side, folded items (49, 60) can be delivered from adjacent folding tables (38, 59), which items are deliverably below the collecting tables (39) to selectively, one of:

further collecting tables (39);

to a stapling or stitching station;

to a gluing station (94–96).

5. Device according to claim 1, characterized in that the breaking stages (e.g., 13) include a lower and an upper braking belt system (101, 102) having a variable speed, which is disposed between a first belt system (97, 98) traveling at a higher speed at $V_1$ and a second belt system (99, 100) having a lower speed ($V_2$), the braking belt system (101, 102) traveling at variable speed and being guided via respective free-wheeling elements (120, 117, 118) on shafts (112, 115), on which the belt systems (97, 98; 99, 100) traveling at the higher ($V_1$) and the lower ($V_2$) speed are also guided in a slip-free manner.

6. Device according to claim 1, characterized in that the cut items are transported in a conveyor path; and the deflectors (12) are each divided via fixed tongues (144) by means of deflecting devices (140, 141) secured to revolving belt systems (138, 139) disposed on both sides of the conveyor path.

7. Device according to claim 1, characterized in that the cut items are transported in a conveyor path; and the deflectors (FIG. 6) have blowing nozzles (134, 135) on either side of the conveyor path, which divert the cut items into one of two belt systems (130, 131), each comprise a fixed inner tube (136, 137), on which blown air openings (134, 135) can be uncovered cyclically by means of a rotating outer tube (133, 132) having openings (126, 127) therein.

* * * * *